US005383385A

United States Patent [19]

Gilbert

[11] Patent Number: 5,383,385

[45] Date of Patent: Jan. 24, 1995

[54] COLLAPSIBLE GUITAR HAVING PIVOTAL HEAD

[76] Inventor: Clifford W. Gilbert, 305 S. Jackson St., Bay City, Mich. 48708

[21] Appl. No.: 68,158

[22] Filed: May 28, 1993

[51] Int. Cl.[6] ..... G10D 1/08

[52] U.S. Cl. ..... 84/267; 84/291; 84/293

[58] Field of Search ..... 84/291, 267, 293, 292, 84/268, 275, 269, 274

[56] References Cited

U.S. PATENT DOCUMENTS

| | | | |
|---|---|---|---|
| 3,910,151 | 10/1975 | Copeland | 84/267 |
| 4,073,211 | 2/1978 | Jorgenson | 84/291 |
| 4,111,093 | 9/1978 | Field et al. | 84/267 |
| 4,191,085 | 3/1980 | Litwin | 84/293 |
| 4,201,108 | 5/1980 | Bunker | 84/267 |
| 4,686,882 | 8/1987 | Shaw | 84/291 |
| 4,770,079 | 9/1988 | Mastroianni | 84/291 |
| 4,939,970 | 7/1990 | Hoshino et al. | 84/293 |

*Primary Examiner*—Michael L. Gellner
*Assistant Examiner*—Cassandra C. Spyrou
*Attorney, Agent, or Firm*—Charles W. Chandler

[57] ABSTRACT

A guitar can be collapsed into a compact condition by pivotably attaching the neck of the guitar to the guitar body, such that the neck can be overturned onto (or near) the upper face of the guitar body. The pivotable attachment includes two parallel swingable links that enable an end of the neck to move into or out of a recess in an end surface of the guitar body without disturbing the tension setting of the guitar strings. It is unnecessary to loosen the string tension prior to swinging the neck onto or out of the guitar body recess.

17 Claims, 2 Drawing Sheets

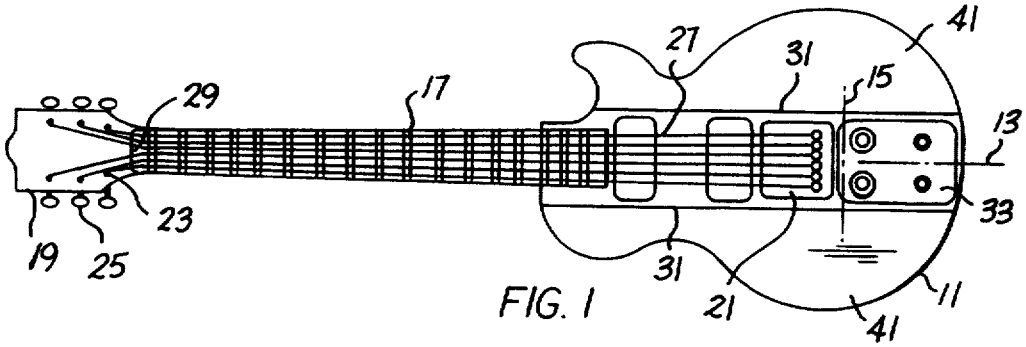
FIG. 1
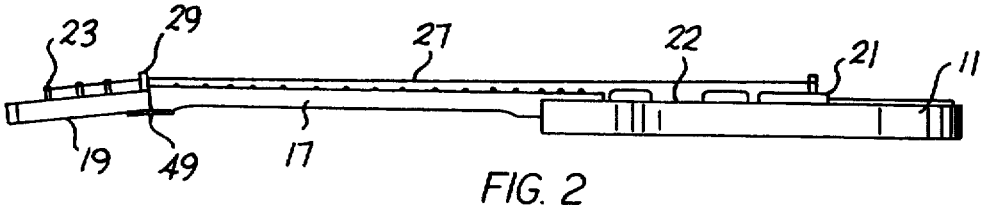
FIG. 2
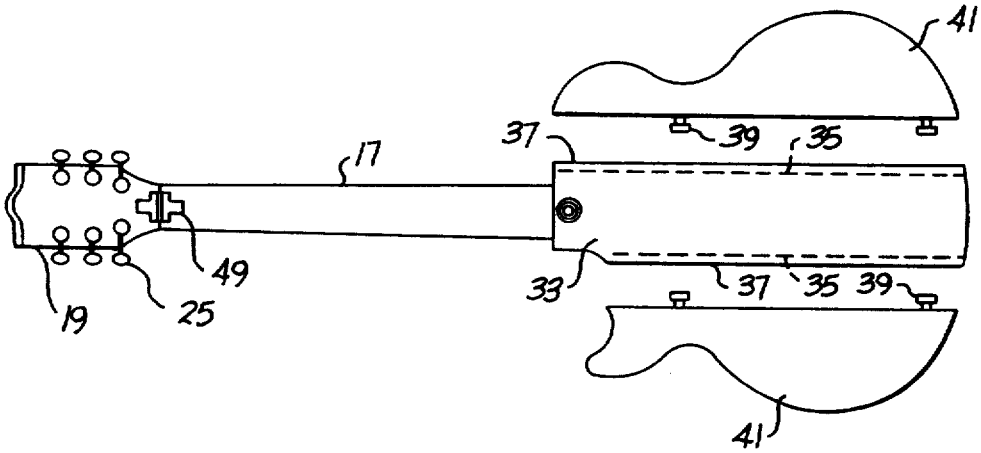
FIG. 3
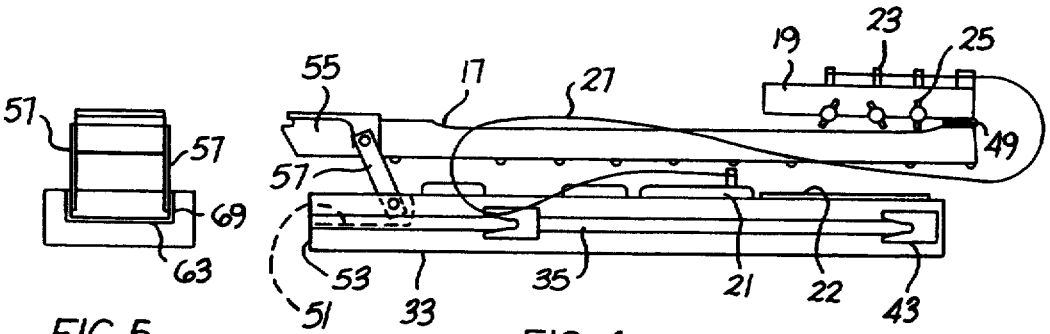
FIG. 4
FIG. 5

COLLAPSIBLE GUITAR HAVING PIVOTAL HEAD

BACKGROUND OF THE INVENTION

The invention relates to musical instruments, and more particularly to guitars. A principal feature of the invention is the use of collapsible or foldable connections between the guitar components, whereby the guitar can be collapsed into a relatively small size package for easier and more compact transport or shipment.

PRIOR DEVELOPMENTS

U.S. Pat. No. 4,073,211 which was issued to A. C. Jorgenson Feb. 14, 1978, discloses a guitar having a neck hingedly connected to the guitar body. The neck can be folded underneath the guitar body for storage within a recess in the guitar body. However, before the neck can be folded to the storage position, the guitar strings have to be disconnected from the bridge that anchors the strings to the guitar body. The patentee does not indicate that the guitar strings have to be retightened and tuned to restore the guitar to its playing condition. However, it is believed that in practice such string retightening and retuning would be necessary. The need for retightening and retuning the strings is a disadvantage of the Jorgenson guitar structure.

U.S. Pat. No. 4,191,085, which was issued to Bradley Litwin Mar. 4, 1980, discloses a collapsible guitar. The neck is detachably connected to the guitar body by a tenon secured to the end face of the neck. The tenon fits into a slot in the guitar body, held by a tapered pin that extends through a rear wall of the slot into a tapered hole in the tenon. The patentee indicates at column 4, line 50, of the patent specification that the string tension has to be relaxed prior to separating the neck from the guitar body. Thus, the guitar has to be retuned when being restored to a playable condition.

U.S. Pat. No. 4,770,079, which was issued Sep. 13, 1988, discloses a collapsible guitar having a neck detachably connected to the guitar body by a screw and two alignment pins. The screw extends through a block secured to the back face of the guitar body into a threaded opening in the neck. The patentee indicates at column 4, line 27, of the specification that the tension of the guitar strings must be relaxed before the neck can be disconnected from the guitar body. It is believed that in practice the guitar would require retuning of the slackened strings when restoring the guitar to its playing mode.

U.S. Pat. No. 4,111,093 which issued Sep. 5, 1978 to Roger Field and Thomas Steger discloses a foldable guitar wherein the neck is pivotably attached to the guitar body, and swings swinging to a position underlying the guitar body. A gear system is associated with the pivot connection and with the string anchorage so that when the neck is moving to its storage position, the string anchorage is, at the same time, moving a corresponding distance to relax the string tension. When the neck is returned to its operating position, the gear system returns the string anchorage to its original position. The intent of the arrangement is to avoid relaxing the strings and retuning the instrument when the neck is returned to its playing position.

SUMMARY OF THE INVENTION

The present invention is directed to a collapsible guitar wherein there is no necessity for retuning the instrument after it has been re-assembled.

In a preferred embodiment of the invention, the collapsible guitar comprises a guitar body, and an elongated neck hingedly connected to one end of the guitar body so that the neck can be overturned onto the upper face of the guitar body without detaching the strings from their anchored connections with the guitar body and pegboard. The guitar strings do not have to be retensioned or retuned when the neck is swung back to its operating position.

The pivotal connection between the guitar body and the neck comprises a swingable link means having one end pivotably connected to the guitar body, and the other end pivotably connected to the neck. The swingable link means enables the neck to be overturned into a position above the upper face of the guitar body, such that opposed components on the neck and guitar body do not forcibly contact one another or otherwise present a clearance problem. When the neck is being returned to an operating position, the link means enables the neck to be swung into a recess in the guitar body with the end of the neck entering into a notch at the end of the recess. A flat plate carried by the neck fits into the notch so that the neck can be manually swung down to an operative position rigidly secured to the guitar body. The notch acts as a fulcrum that permits the musician to apply sufficient manual pressure on the neck to restore the guitar strings to their original tensions. The link type connection between the guitar body and the neck eliminates the need for retensioning or retuning the guitar strings after the neck has been returned to its playing position.

In the preferred practice of the invention, the guitar pegboard is hingedly connected to the neck remote from the guitar body. The pegboard folds into the back face of the neck so as to further reduce the overall length of the guitar when the guitar components are in their storage positions. In a typical guitar construction embodying the invention, a guitar having a length of about 40 inches can be collapsed to a length of approximately 18 inches.

To further reduce the size of the collapsed guitar, the guitar body may be formed to include a central section and two side sections. The three sections can be stored alongside one another so as to appreciably reduce the overall width of the collapsed guitar. In a typical guitar structure embodying the invention, the width of the collapsed guitar is much smaller than the width of the guitar in the playing mode.

THE DRAWINGS

FIG. 1 is a top plan view of a guitar embodying the invention.

FIG. 2 is a side elevational view of the guitar shown in FIG. 1.

FIG. 3 is a bottom plan view of the FIG. 1 guitar, but with the guitar body separated into sections for storage or carrying purposes.

FIG. 4 is an elevational view taken in the direction of arrow 4 in FIG. 3, but with the guitar components folded into a compact package.

FIG. 5 is a partial end view of the structure depicted in FIG. 4.

DESCRIPTION OF THE PREFERRED EMBODIMENT

Figure 6:
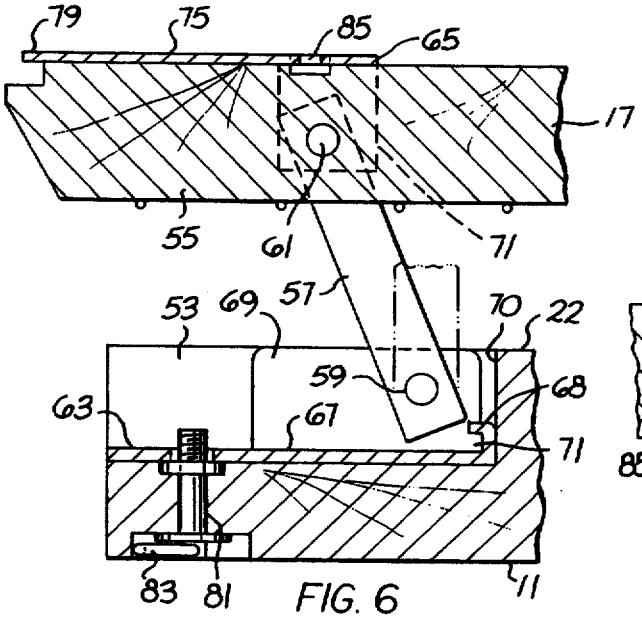
FIG. 6 is a fragmentary enlarged sectional view of a pivotable connection used in the FIG. 1 guitar between the guitar body and the neck.

FIGS. 1 through 3 show a collapsible guitar that includes a guitar body 11 having a longitudinal axis 13 and a transverse axis 15. An elongated neck 17 extends from the guitar body on the longitudinal axis.

The guitar further comprises a pegboard 19 connected to neck 17 remote from the guitar body, a string anchorage means 21 on the upper face 22 of the guitar body, and a plurality of adjustable string anchorage pegs 23 located on the pegboard.

Each peg 23 is connected to an adjusting knob or handle 25, via a pinion gear system located within pegboard 19, whereby the guitar strings 27 can be individually tensioned to the designated state of tension corresponding to a particularly note on the musical scale. The illustrated guitar has six strings 27. Each string is individually adjusted to a desired state of tension. A comb structure 29 on the pegboard supports the strings.

Guitar body 11 comprises three solid wood sections connected together on two separation planes 31, 31 extending parallel to the guitar body longitudinal axis 13. Central section 33 of the guitar body has two grooves 35 formed in its side edges 37. Each groove provides clearance for two headed pins 39 projecting from the edge of an associated guitar body side section 1.

Figure 8:
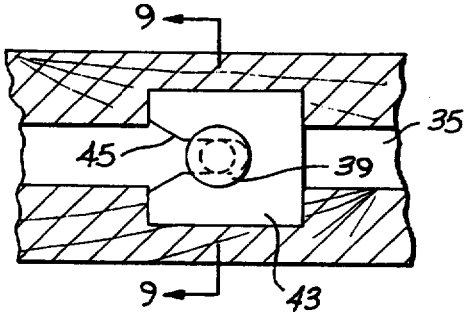
FIG. 8 is taken on line 8—8 in FIG. 9.
Figure 9:
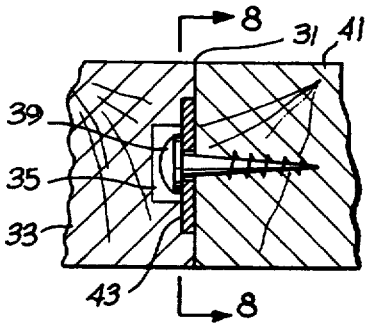
FIG. 9 is a sectional view taken on line 9—9 in FIG. 8.

FIG. 1 shows the guitar body, with central section 33 connected to side sections 41. FIG. 3 shows the guitar body in a collapsed (or dismantled) mode wherein the side sections 41 are separated from central section 33. FIGS. 8 and 9 show the method of connecting each side section to the central section.

As shown in FIGS. 8 and 9, a metal plate 43 is secured to the side edge of guitar body section 41. Slot 45 of the plate overlies groove 35 in the edge of central section 33 of the guitar body. Each guitar body section 41 has two headed pins 39, as shown in FIG. 3. When the side edge of central section 33 is positioned flatwise against the side edge of an associated guitar body section 41, as shown in FIG. 9, the guitar body sections can be slid parallel to the separation plane 31 (FIG. 1) to cause the headed pins 39 to interlock with slotted plates 43, thereby rigidly attaching the central section 33 to side section 41. A reverse slidable motion is used to disconnect central section 33 from side section 41. The same procedure is used for connecting (or disconnecting) the central section 33 relative to each side section 41.

Figure 10:
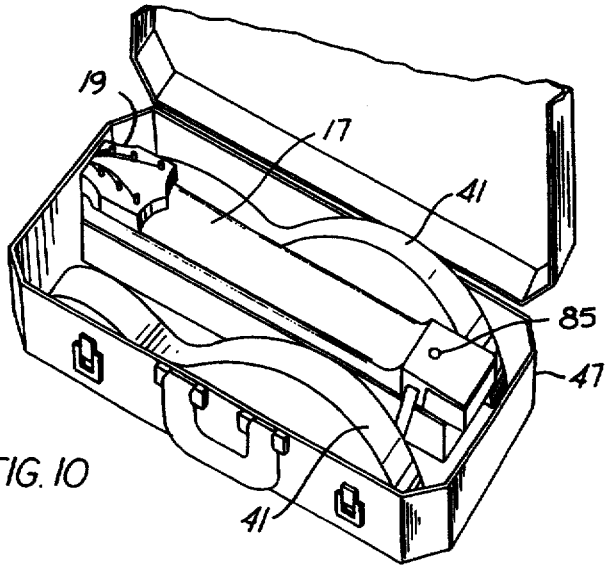
FIG. 10 is a perspective view of the FIG. 1 guitar collapsed and packaged in a suitable carrying case.

By disconnecting the three sections of the guitar body, it is possible to appreciably reduce the effective width dimension of the guitar body, thereby enabling the guitar body to be compactly stored in a relatively small size package. FIG. 10 shows the collapsed (or sectionalized guitar body) inserted into a travelling case 47.

The central section 33 of the guitar body is pivotably connected to neck 17 so that the neck can be overturned onto the upper face 22 of the guitar body, reducing the guitar body length. FIG. 4 shows the neck in the overturned position. To further reduce the overall length of the guitar, the pegboard 19 has a hinged connection 49 with the neck 17, whereby the pegboard can be overturned onto the upper face of the neck; FIG. 4 illustrates the pegboard in its overturned position.

To achieve the collapsed condition of FIG. 4, it is not necessary to turn knobs 25 to reduce the string tension. The strings 27 can be left in a tensioned condition while neck 17 is being moved to its FIG. 4 collapsed position, and also while the neck is being returned to the operating position (FIG. 2).

Figure 7:
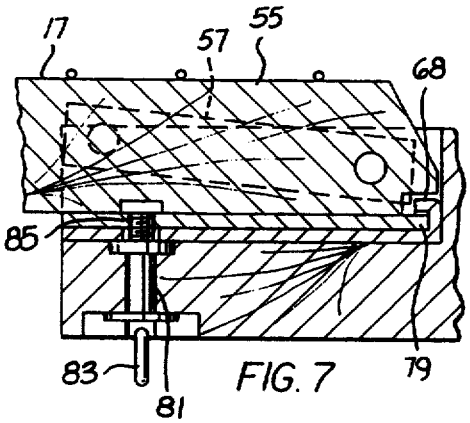
FIG. 7 is a sectional view taken in the same direction as FIG. 6, but showing the guitar body and neck in the operative (non-collapsed) condition.

FIGS. 4 through 7 illustrate the structural features of the pivotal connection that exists between the guitar body and neck 17. Guitar body 11 has a rectangular recess 51, defined by end surface 53 and upper surface 22. End portion 55 of neck 17 fits into the recess, as shown in FIG. 7.

As best shown in FIGS. 4, 5 and 6, the end portion of neck 17 is connected to the guitar body by two parallel links 57. The links are flat metal strips having pivotal connections 59 and 61 with two U-shaped metal brackets 63 and 65 mounted, respectively, on guitar body 11 and neck 17. When the end portion of neck 17 is seated within recess 51, as shown in FIG. 7, the parallel links 57 are disposed alongside the neck side surfaces in the space formed by bracket 63.

Bracket 63 comprises a flat plate 67 and two upstanding ears 69 that form pivotal attachments for the two links 57. The rightmost edge of plate 67 comprises a flange 68 projecting leftwardly from internal end surface 70 of recess 51 to form a ledge overlying a notch 71. This notch is used as a fulcrum surface to swing neck 17 into recess 51 with sufficient force to achieve a satisfactory tension on strings 27.

Bracket 65 comprises a second flat plate 75 and two ears 77 that form pivotal attachments for links 57. End edge 79 of plate 75 forms a lip adapted to extend into notch 71 for swinging neck 17 into recess 51, as shown in FIG. 7.

FIG. 6 fragmentarily shows neck 17 in its so-called "over-turned" position, more fully shown in FIG. 4. To return the neck to its operating position (depicted in FIG. 7 and 2), the neck is shifted slightly to the right until links 57 are essentially upright (as fragmentarily shown in dashed lines in FIG. 6); neck 17 is then swung counter clockwise around pivot connection 61 such that edge 79 of plate 75 slides along the surface of plate 67 into notch 71.

After edge 79 of plate 75 is positioned within notch 71, a downward manual force is applied to neck 17 to move the neck to its end position. The elongated neck acts as a lever to tension strings 27 to their normal operating tensions. When the guitar components are in the collapsed condition of FIG. 4, strings 27 are slack, i.e. non-tensioned. However, when the neck 17 is returned to its original operating condition (FIGS. 2 and 7) the string tension is restored. The strings do not usually have to be retuned.

A screw lock means locks neck 17 to the guitar body. As shown, the screw lock means comprises a screw 81 captively mounted in the guitar body so as to extend through a clearance opening in plate 67. A foldable turnbuckle 83 is provided for manually turning the screw. Metal plate 75 has a threaded opening 85 that aligns with the screw when neck 17 is moved to the FIG. 7 position. The screw can then be manually turned to thread into opening 85, thereby rigidly locking neck 17 to the guitar body. The screw is turned in the reverse direction for unlocking neck 17 from the guitar body.

When the assembly of guitar body 33 and neck 17 is in the overturned (collapsed) condition, as shown in FIG. 4, the assembly can be placed into travelling case 47 (FIG. 10) between the two guitar body side sections 41. The invention resides in the collapsing features whereby the guitar can be collapsed to the FIG. 10 condition and later assembled to the operating condition depicted in FIG. 2. The link construction depicted in FIGS. 6 and 7 constitutes an important feature of the invention in that it enables the desired operations to be achieved without disturbing the string tension.

Having described my invention I claim:

1. A collapsible guitar comprising an elongated guitar body having a longitudinal axis and a transverse axis; said body having an upper face and a lower face; an elongated neck extending from said guitar body on the longitudinal axis; a pegboard connected to said elongated neck remote from the guitar body; string anchorage means on the upper face of said guitar body; a plurality of adjustable string anchorage pegs on said pegboard; a plurality of guitar strings extending from said string anchorage means along said neck to said anchorage pegs adjacent said upper face; and a first pivotal connection between said guitar body and one end of said neck; said first pivotal connection being located so that the neck can be overturned onto the upper face of the guitar body without detaching the guitar strings from said anchorage means or said pegs, a second pivotal connection between the opposite end of the neck and the pegboard such that the pegboard can be overturned onto the neck to reduce the overall length of the neck and the pegboard.

2. The collapsible guitar of claim 1, wherein said first pivotal connection comprises link means having a first pivotal attachment attached to said guitar body and a second pivotal attachment attached to said neck.

3. The collapsible guitar of claim 1, wherein said guitar body has an end surface extending generally normal to said upper surface; said guitar body having a generally rectangular recess extending into the corner defined by said end surface and said upper surface; said neck having an end portion fitting within said recess when the guitar is in a non-collapsed condition; said first pivotal connection comprising link means pivotally attached to the guitar body and to said end portion of the neck.

4. The collapsible guitar of claim 3, wherein said link means comprises two parallel link elements located within said recess when the guitar is in said non-collapsed condition.

5. The collapsible guitar of claim 4, wherein said recess has an internal flat floor surface extending parallel to the upper surface of the guitar body; and a screw-lock means extending through the guitar body and said internal flat floor surface into the recess; said neck having a flat undersurface seated against the internal floor surface of the recess when the guitar is in said non-collapsed condition; said screw lock means being turnable to thread into the flat undersurface of the neck whereby the neck is rigidly attached to the guitar body.

6. The collapsible guitar of claim 5, wherein said recess further comprises an internal end surface extending generally normal to the upper surface of the guitar body, and a ledge wall projecting from said internal surface end to form a notch; said neck having a lip extending into said notch underneath the ledge when the flat undersurface of the neck is seated against the flat floor surface of the recess.

7. The collapsible guitar of claim 6, and further comprising a first wear-resistant bracket secured to said guitar body within said recess; said first bracket including a first flat plate defining the floor surface of the recess, and two parallel ears extending from said plate to form pivotal attachments for said parallel link elements; and a second wear-resistant bracket secured to the portion of said neck that is seated within the recess; said second bracket including a second flat plate defining the flat undersurface of the neck, and two parallel ears extending from said second plate to form pivotal attachments for said parallel link elements.

8. The collapsible guitar of claim 7, wherein said first bracket comprises a reversely turned flange extending from said first flat plate to form said ledge wall; said second flat plate having an end edge thereof defining said lip.

9. The collapsible guitar of claim 8, wherein said reversely turned flange is dimensioned to form a relatively shallow notch, whereby the notch can form a fulcrum surface when the end edge of the second plate is inserted into the notch in order to swing said second plate toward the floor surface of the recess.

10. The collapsible guitar of claim 7, and further comprising a threaded opening in said second flat plate, said threaded opening being alignable with said screw lock means so that when the end portion of the neck fits with the recess, the screw lock means can be turned to thread into the threaded opening in the second plate.

11. The collapsible guitar of claim 1, wherein said guitar body has a recess in its upper surface; said neck having an end portion thereof fitting within said recess when the guitar is in a non-collapsed condition; said pivotal connection comprising two spaced parallel link elements extending along side surfaces of said neck end portion; one end of each of said link elements being pivotally attached to the guitar body, the other end of each of said link elements being pivotally attached to said neck end portion; said link elements being disposed within the recess when the guitar is in said non-collapsed condition wherein the neck end portion fits within the recess; said neck being raisable away from the guitar body so that the parallel link elements are enabled to swing upwardly to a point where the link elements are normal to the guitar body upper surface; said neck being then swingable about its connection with the parallel link elements to assume an overturned position extending along the guitar body upper face.

12. The collapsible guitar of claim 1, wherein said guitar body comprises a central section and two side sections connected to the central section on opposite sides thereof; said side sections being separable from the center section on separation planes extending parallel to the guitar body longitudinal axis.

13. The collapsible guitar of claim 12, wherein said central section of the guitar body has a transverse width dimension that is approximately the same as the transverse width dimension of each of said side sections.

14. The collapsible guitar of claim 12, including a slidable interlocking connection attaching said central section of the guitar body to an associated one of said side sections, said slidable interlocking connection comprising interlocking connectors movable parallel to the separation plane associated with said associated one of said side sections.

15. The collapsible guitar of claim 14, wherein each of said interlocking connections is a pin-slot connection.

16. The collapsible guitar of claim 1, wherein said pegboard has an undersurface, and said neck has an undersurface; said second hinged connection having a hinge axis located at the juncture between the neck undersurface and the pegboard undersurface, such that when the guitar strings are tensioned, the pegboard is rigidly abutted against the neck.

17. The collapsible guitar of claim 16, wherein the guitar body, neck and pegboard are dimensioned so that the guitar can be collapsed to a length less than one-half the length of the guitar in said non-collapsed condition.

* * * * *